US005822723A

United States Patent [19]

Kim et al.

[11] Patent Number: 5,822,723

[45] Date of Patent: Oct. 13, 1998

[54] ENCODING AND DECODING METHOD FOR LINEAR PREDICTIVE CODING (LPC) COEFFICIENT

[75] Inventors: Moo-young Kim, Sungnam; Nam-kyu Ha, Suwon; Sang-ryong Kim, Kyungki-do, all of Rep. of Korea

[73] Assignee: Samsung Ekectrinics Co., Ltd., Rep. of Korea

[21] Appl. No.: 710,943

[22] Filed: Sep. 24, 1996

[30] Foreign Application Priority Data

Sep. 25, 1995 [KR] Rep. of Korea ..... 95-31676

[51] Int. Cl.[6] ..... G10L 3/02

[52] U.S. Cl. ..... 704/222; 704/219

[58] Field of Search ..... 704/222, 219, 704/221, 223, 224, 262, 263, 264, 265, 266, 205, 206

[56] References Cited

U.S. PATENT DOCUMENTS

| | | | |
|---|---|---|---|
| 5,012,518 | 4/1991 | Liu et al. | 704/222 |
| 5,151,968 | 9/1992 | Tanaka et al. | 704/200 |
| 5,384,891 | 1/1995 | Asakawa et al. | 395/2.39 |
| 5,487,128 | 1/1996 | Ozawa | 395/2.31 |
| 5,677,986 | 10/1997 | Amada et al. | 395/2.31 |
| 5,682,407 | 10/1997 | Funaki | 375/240 |

OTHER PUBLICATIONS

Paliwal et al.; "Efficient Vector Quantization of LPC Parameters at 24 Bits/Frame"; IEEE, vol. 1, No. 1, Jan. 1993.

*Primary Examiner*—Richemond Dorvil
*Attorney, Agent, or Firm*—Leydig, Voit & Mayer

[57] ABSTRACT

A speech signal encoding/decoding method is provided. The method of encoding LPC coefficients includes dividing the nth-order line spectral frequencies into lower, middle and upper code vectors, quantizing the middle code vectors using a middle code book to generate a first index, selecting one of a plurality of lower code books according to the lowermost line spectral frequency of the middle code vector and the line spectral frequencies of the lower code vectors, and quantizing the lower code vectors using the selected lower code book to generate a second index, selecting one of a plurality of upper code books according to the uppermost line spectral frequency of the middle code vector and the line spectral frequencies of the upper code vectors, quantizing the upper code vectors using the selected upper code book to generate a third index, and transmitting the first, second and third indexes. In the above quantization, the line spectral frequencies are quantized using a linked split vector quantization (LSVQ), and the search of the code book is efficiently performed, so that the spectral distortion and outlier percentages are lower at 23 bits/frame than those of the split vector quantization (SVQ) at 24 bits/frame.

10 Claims, 5 Drawing Sheets

ENCODING AND DECODING METHOD FOR LINEAR PREDICTIVE CODING (LPC) COEFFICIENT

BACKGROUND OF THE INVENTION

The present invention relates to the encoding and decoding of a speech signal, and more particularly, to an encoding/decoding method of line spectral frequencies (LSF's) relevant to quantization of linear predictive coding (LPC) coefficient.

As a method for quantizing an analog signal, one can employ scalar quantization and vector quantization. In the scalar quantization, input signals are individually quantized as in a pulse code modulation (PCM), differential pulse code modulation (DPCM), adaptive pulse code modulation (ADPCM) and the like. In the vector quantization, the input signals are considered as several rows of signals which are relevant to each other, that is, as a vector, and the quantization is performed in the vector unit. As a result of the vector quantization, a codebook index row which is the result of a comparison between an input vector and a codebook is obtained.

In the vector quantization, the quantization is performed in a vector unit in which data are combined into blocks, providing a powerful data compression effect. Thus, vector quantization has been useful in a wide range of applications such as video signal processing, speech signal processing, facsimile transmission, meteorological observations using a weather satellite, etc.

Generally, the application fields of the vector quantization require the storage of massive amounts of data and a wide transmitting bandwidth. Also, some loss is allowed for data compression. According to a rate distortion principle, the vector quantization can provide much better compression performance than a conventional scalar quantization.

Thus, research into the vector quantization is currently underway and since the performance of a vector quantizer depends on a codebook representing a data vector, research regarding the vector quantization has been focused on the preparation of the codebook.

The K-means algorithm was the first codebook preparation method where a codebook is prepared with respect to all input vectors for an overall average distortion of K codevectors to be below a predetermined value. Furthermore, a Linde, Buzo, Gray (LBG) algorithm has been developed by improving the performance of the K-means algorithm. While the size of the codebook is determined in the initial stage in the K-means algorithm, the size of the codeword is increased until the overall average distortion comes to be below a predetermined value to prepare an intended size of the codebook in the LBG algorithm. In the case of the LBG algorithm, the convergence to the predetermined distortion value is faster than that in the K-means algorithm.

Recently, research into quantizing LPC coefficient by allocating fewer bits has been underway in the speech encoding fields. It is difficult to quantize the LPC coefficient directly due to their excessive variation. Thus, the LPC coefficient should be converted into LSF's prior to the quantization, wherein the LSF's quantization methods are as follows.

First, there is a scalar quantization method. According to this scalar quantization method, each LSF is individually quantized, so that at least 32 bits per frame are required for producing high quality speech. However, most speech coders with transmission rates below 4.8 Kbps do not allocate more than 24 bits per frame for quantizing the LSF's.

Thus, in order to reduce the number of bits, various algorithms for vector quantization have been developed. Since a reference codebook should be prepared using training data first in the vector quantization, the number of bits per frame can be reduced. However, the vector quantization has limitations in: (1) amount of memory used for storing the codebook and (2) time required for searching a code-vector.

To compensate for the above limitations, a split vector quantization (SVQ) method has been suggested. According to this SVQ method, each of the LSF's is divided in to three parts and each part is separately quantized, thereby saving memory and time.

In the SVQ method, for example, the 10th-order LSF is divided into three codevectors as lower codevector ($\omega_1$, $\omega_2$, $\omega_3$), middle codevector ($\omega_4$, $\omega_5$, $\omega_6$) and upper codevector ($\omega_7$, $\omega_8$, $\omega_9$, $\omega_{10}$) as follows.

$$\{(\omega_1, \omega_2, \omega_3), (\omega_4, \omega_5, \omega_6), (\omega_7, \omega_8, \omega_9, \omega_{10})\}$$

Here, each quantized code vector is expressed as follows.

$$\{(\omega_1, \omega_2, \omega_3), (\omega_4, \omega_5, \omega_6), (\omega_7, \omega_8, \omega_9, \omega_{10})\}$$

In the SVQ method, the LSF's are quantized by the following two steps.

Step 1: quantizing the middle codevector.

Step 2: selectively quantizing only lower and upper codevectors which satisfy an ordering property, as shown in the following formula of LST's, within the codebook.

$$\omega_3<\omega_4,\ \omega_6<\omega_7$$

Thus, after the middle codevector ($\omega_4$, $\omega_5$, $\omega_6$) is determined, the lower codevector satisfying a relation that $\omega_3$ is greater than $\omega_4$ and the upper codevector satisfying a relation that $\omega_6$ is greater than $\omega_7$ are not used, so that a searching space for the vector quantization is reduced, thus lowering the quality of speech. That is, according to the SVQ method, since a plurality of codevectors which violate the ordering property of the LSF's exist, the searching space for the vector quantization is reduced.

For efficiency in using the searching space, a method of quantizing the difference between adjacent LSF's has been suggested. However, a quantization to the upper LSF's, thereby providing inferior performance.

SUMMARY OF THE INVENTION

It is an object of the present invention to provide a method for converting linear predictive coding (LPC) coefficient into nth-order line spectral frequencies (LSF's) and training a codebook required for vector-quantizing the LSF's in a speech encoding.

It is another object of the present invention to provide a method for encoding LPC coefficient depending on the relevance therebetween in quantizing the LSF's which is divided into a plurality of code vectors.

It is still another object of the present invention to provide a method for decoding a codebook index, coded depending on the relevance between the LSF's, into the original LSF's.

To achieve the first object, a codebook training method which is required for vector-quantizing a nth-order LSF's, after a linear predictive coding (LPC) coefficient is converted into the nth-order linear spectral frequencies (LSF's) coefficient in a speech encoding, the codebook training method comprises the steps of:

(a) dividing the nth-order LSF's into lower, middle and upper code vectors;

(b) training the middle code vectors with a middle codebook (COM);

(c) training the lower code vectors with a plurality of lower codebooks (COL) in dependence on relation between a lowermost LSF of the middle code vectors and the LSF's of the lower code vectors; and (d) training the upper code vectors with a plurality of upper codebooks (COU) in dependence on relation between a uppermost LSF of the middle code vectors and the LSF's of the upper code vectors.

To achieve the second object, a method of encoding line predictive encoding (LPC) coefficient in a speech encoding where linear predictive coding (LPC) coefficient is converted into nth-order linear spectral frequencies (LSF's) coefficient and the LSF's is quantized, the encoding method comprises the steps of:

(a) dividing the nth-order LSF's into lower, middle and upper code vectors;

(b) quantizing the middle code vectors using a middle codebook (COM) to generate a first index;

(c) selecting one of lower codebooks (COL) according to the lowermost LSF of the middle code vector and the LSF's of the lower code vectors, and quantizing the lower code vectors using the selected COL to generate a second index;

(d) selecting one of upper codebooks (COU) according to the uppermost LSF of the middle code vector and the LSF's of the upper code vectors, and quantizing the upper code vectors using the selected COU to generate a third index; and (e) transmitting the first, second and third indexes.

To achieve the third object, a method of decoding first, second and third indexes which are generated by dividing a nth-order LSF's coefficient into lower, middle and upper code vectors and then quantizing the divided code vectors into the line spectral frequencies (LSF's) coefficient, wherein the decoding method comprises the steps of:

(a) selecting a codevector corresponding to the first index using a middle codebook to generate quantized middle code vectors;

(b) selecting one of lower codebooks COL according to a lowermost LSF of the middle code vectors generated in the step (a) and selecting a codevector corresponding to the second index using the selected lower codebook COL to generated quantized lower code vectors; and (c) selecting one of upper codebooks COU according to the uppermost LSF of the middle code vectors generated in the step (a) and selecting a codevector corresponding to the third index using the selected upper codebook COU to generated quantized upper code vectors.

BRIEF DESCRIPTION OF THE DRAWINGS

The above objects and advantages of the present invention will become more apparent by describing in detail a preferred embodiment thereof with reference to the attached drawings in which.

DETAILED DESCRIPTION OF THE INVENTION

Figure 1:
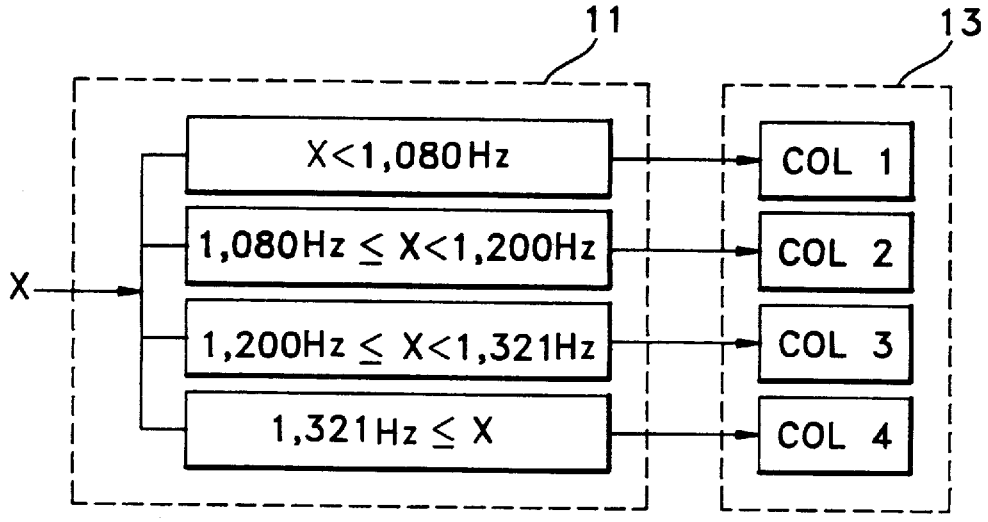
FIG. 1 is a diagram showing a first classifier used in the present invention.

As shown in FIG. 1, according to the present invention, a first classifier 11 which is used for training encoding and decoding processes, selects one of the four codebooks 13, COL1 to COL4, according to the value of an input X, which is commonly used in the training, encoding and decoding processes.

That is, assuming that the input X of the first classifier 11 is $\omega_4$, the first classifier 11 selects the codebook COL1 if $\omega_4$ is less than 1,080 Hz, the codebook COL2 if $\omega_4$ is equal to or greater than 1,080 Hz and less than 1,200 Hz, the codebook COL3 if $\omega_4$ is equal to or greater than 1,200 Hz and less than 1,321 Hz, and the codebook COL4 if $\omega_4$ is equal to or greater than 1,321 Hz, respectively.

Figure 2:
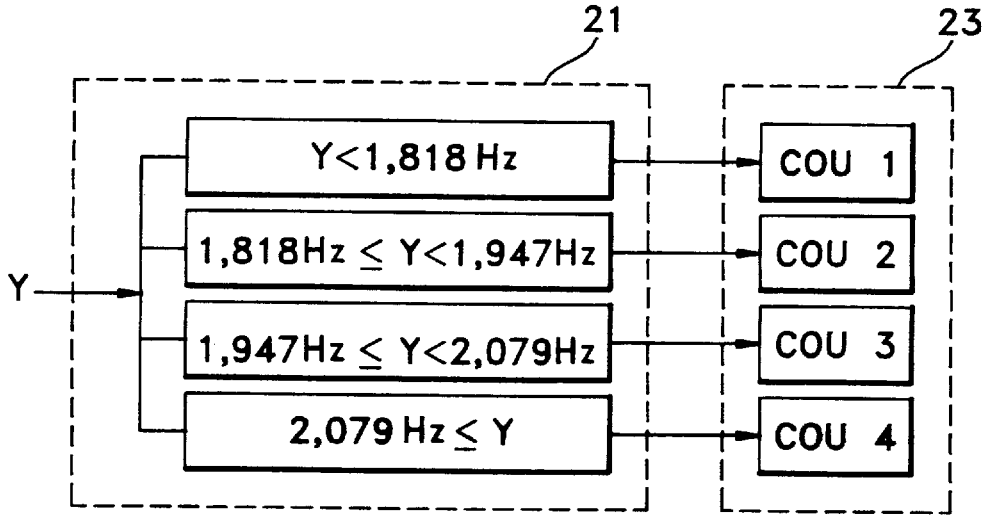
FIG. 2 is a diagram showing a second classifier used in the present invention.

FIG. 2 is a diagram showing a second classifier 21 used for training the encoding and decoding processes according to the present invention. The second classifier 21 selects one of four codebooks 23, COU1 to COU4, according to the value of input Y, which is commonly used in the training, encoding, and decoding processes.

That is, assuming that the input Y of the second classifier 21 is $\omega_6$, the second classifier 21 selects the codebook COU1 if $\omega_6$ is less than 1,818 Hz, the codebook COU2 if $\omega_6$ is equal to or greater than 1,818 Hz and less than 1,947 Hz, the codebook COU3 if $\omega_6$ is equal to or greater than 1,947 Hz and less than 2,079 Hz, and the codebook COU4 if $\omega_6$ is equal to or greater than 2,079 Hz, respectively.

Figure 3:
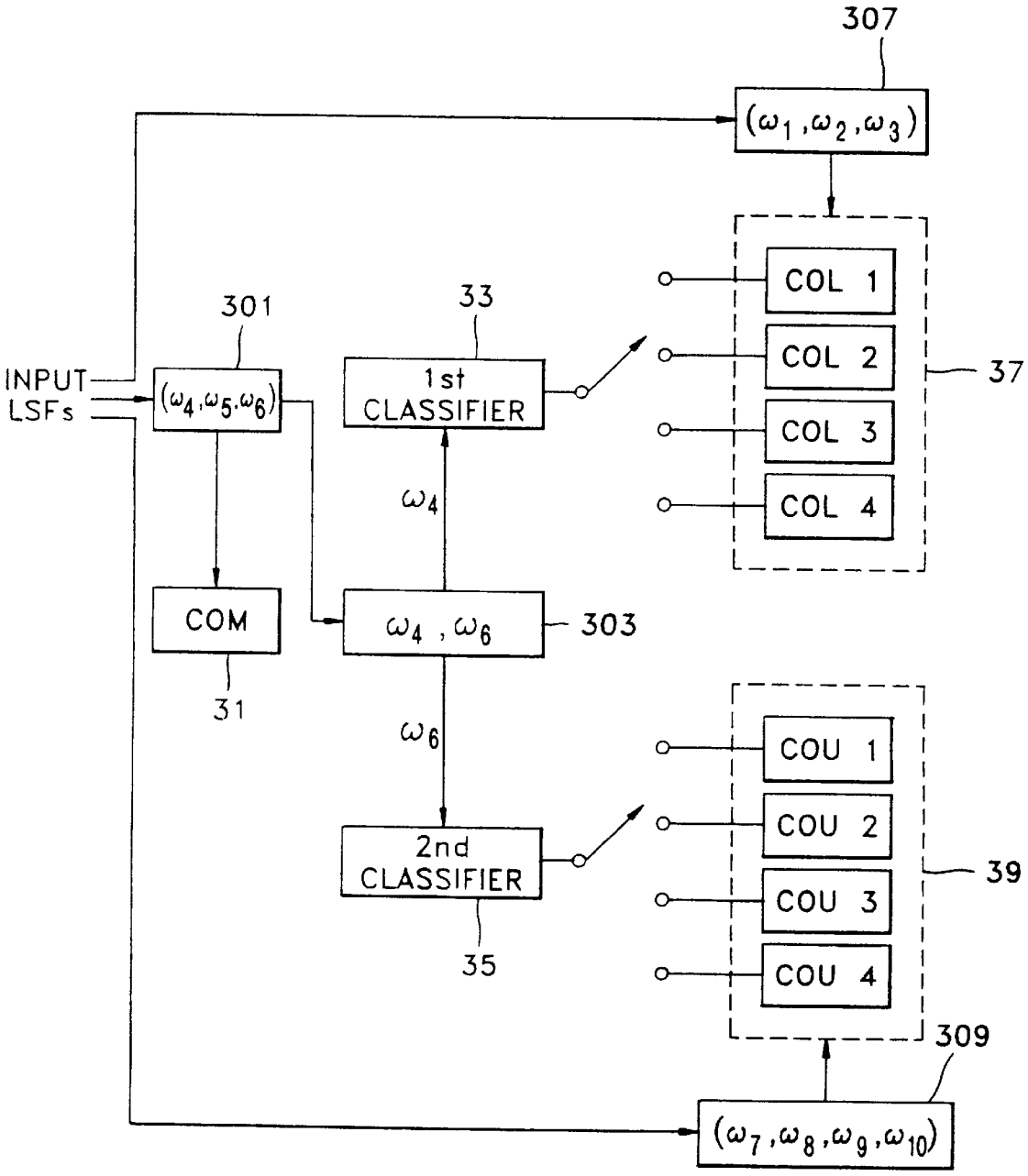
FIG. 3 is a device diagram realizing a codebook training method for vector-quantizing LPC coefficient according to the present invention.

FIG. 3 is a diagram illustrating a codebook training method for vector-quantizing an LPC coefficient according to the present invention.

Figure 6A:
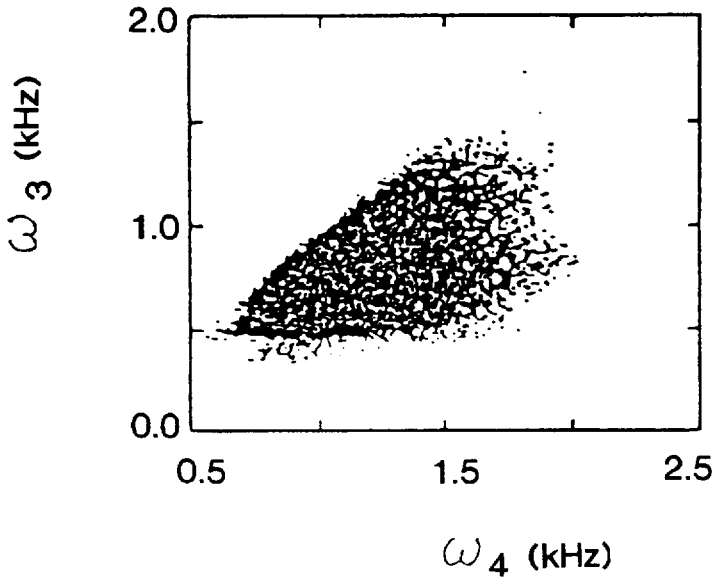
FIGS. 6A and 6B are diagrams showing joint distributions of $\omega_4$ and $\omega_3$, and $\omega_6$ and $\omega_7$ with respect to the training data, respectively.
Figure 6B:
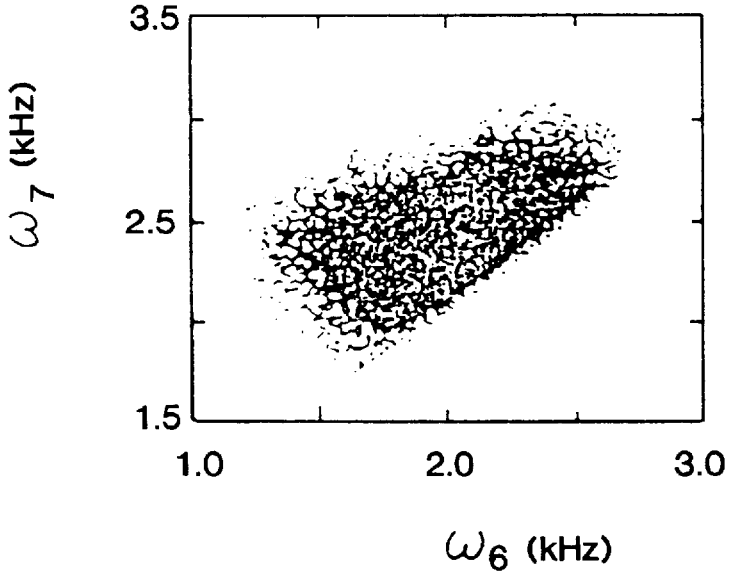

First, referring to FIGS. 6A to 6E, the joint distribution of LSF's with respect to the training data will be described. FIG. 6A is a diagram showing the joint distribution of $\omega_4$ and $\omega_3$ with respect to the training data, and FIG. 6B is a diagram showing joint distribution of $\omega_6$ and $\omega_7$ with respect to the training data.

As shown in FIG. 6A, $\omega_3$ is changed relative to $\omega_4$. For example, when $\omega_4$ is less than 1,080 Hz, $\omega_3$ varies in the range between 399 Hz and 1,004 Hz. Also, when $\omega_4$ is between 1,080 Hz and 1,200 Hz, $\omega_3$ varies in the range between 486 Hz and 1,095 Hz. Thus, since $\omega_3$ is limited according to the range of $\omega_4$, if $\omega_4$ is already known, a limited range of $\omega_3$ is searched. That is, there is no reason for completely searching $\omega_3$.

Table 1 shows average values of $\omega_1$, $\omega_2$ and $\omega_3$ according to the range of $\omega_4$.

As shown in Table 1, it is known that each average value of $\omega_1$, $\omega_2$ and $\omega_3$ is different according to the range of $\omega_4$. Thus, it is more efficient to train ($\omega_1$, $\omega_2$, $\omega_3$) being linked with the range of $\omega_4$ than to train ($\omega_1$, $\omega_2$, $\omega_3$) independently.

TABLE 1

| range of $\omega_4$ | codebook name | average $\omega_3$ (Hz) | average $\omega_2$ (Hz) | average $\omega_1$ (Hz) |
|---|---|---|---|---|
| $\omega_4 < 1{,}080$ | COL 1 | 720 | 463 | 317 |
| $1{,}080 \leqq \omega_4 < 1{,}200$ | COL 2 | 808 | 518 | 324 |
| $1{,}200 \leqq \omega_4 < 1{,}321$ | COL 3 | 870 | 560 | 339 |
| $1{,}321 \leqq \omega_4$ | COL 4 | 956 | 611 | 362 |

Thus, according to the present invention, the range of $\omega_4$ is divided into $N_L$ classes (here, $N_L$=4) , and ($\omega_1$, $\omega_2$, $\omega_3$) is trained according to the class to which $\omega_4$ belongs.

As a standard for dividing the range of $\omega_4$ into four classes, cumulative probability distributions of the range of $\omega_4$ for each class are matched with each other according to the following formula.

$$\begin{aligned} P(\omega_4 < 1{,}080\text{ Hz}) &= P(1{,}080\text{ Hz} \leqq \omega_4 < 1{,}200\text{ Hz}) \\ &= P(1{,}200\text{ Hz} \leqq \omega_4 < 1{,}321\text{ Hz}) \\ &= P(1{,}321\text{ Hz} \leqq \omega_4) \end{aligned}$$

In the above formula, P(x Hz$\leqq\omega_4$y Hz) means probability that $\omega_4$ exists between x Hz and y Hz.

Also, as shown in FIG. 6B, $\omega_7$ varies relative to $\omega_6$ and each average value of ($\omega_7$, $\omega_8$, $\omega_9$, $\omega_{10}$) is different according to the range of $\omega_6$. Thus, it is more efficient to train ($\omega_7$, $\omega_8$, $\omega_9$, $\omega_{10}$) being linked with the range of $\omega_6$ than to train ($\omega_7$, $\omega_8$, $\omega_9$, $\omega_{10}$) independently in the same manner described above.

Thus, according to the present invention, the range of $\omega_6$ is divided into $N_U$ classes (here, $N_U$=4) and ($\omega_7$, $\omega_8$, $\omega_9$, $\omega_{10}$) are trained according to the class to which $\omega_6$ belongs.

As a standard for dividing the range of $\omega_6$ into four classes, an cumulative probability distributions of the range of $\omega_6$ at each class are matched with each other according to the following formula.

$$\begin{aligned} P(\omega_6 < 1{,}818\text{ Hz}) &= P(1{,}818\text{ Hz} \leqq \omega_6 < 1{,}947\text{ Hz}) \\ &= P(1{,}947\text{ Hz} \leqq \omega_6 < 2{,}079\text{ Hz}) \\ &= P(2{,}079\text{ Hz} \leqq \omega_6) \end{aligned}$$

In the above formula, P(x Hz$\leqq\omega_6$y Hz) means probability that $\omega_6$ exists between x Hz and y Hz.

Referring to FIG. 3, the codebook training method according to the present invention will be described.

(1) Input LSF's are classified into lower code vectors 307, middle code vectors 301 and upper code vectors 309.

(2) The middle code vectors 301 are trained with a codebook of middle code vectors (COM) 31 as a middle codebook using the LBG algorithm.

(3) The range of $\omega_4$ of the training data is divided into $N_L$ classes (here, $N_L$=4) and ($\omega_1$, $\omega_2$, $\omega_3$) corresponding to each class is classified.

(4) The lower code vectors ($\omega_1$, $\omega_2$, $\omega_3$) 307 are trained with a codebook of lower codevector (COL) 37 as lower codebooks of $N_L$ according to the class selected by the first classifier 33 on the basis of $\omega_4$ 303.

(5) The range of $\omega_6$ of the training data is divided into $N_U$ classes (here, $N_U$=4) and ($\omega_7$, $\omega_8$, $\omega_9$, $\omega_{10}$) corresponding to each class is classified.

(6) The upper code vectors 309 are trained with the codebook of upper code vectors (COU) 39 as upper codebooks of $N_U$ according to the class selected by the second classifier 35 on the basis of $\omega_6$ 303.

That is, the COM 31 as the middle codebook is formed by the LEG algorithm in the same manner as in a general split vector quantization (SVQ) method. Also, the codebooks COL 37 and COU 39 are formed of four codebooks, respectively, which are selected by the first and second classifiers 33 and 35 according to the range of $\omega_4$ and $\omega_6$, respectively.

Figure 4:
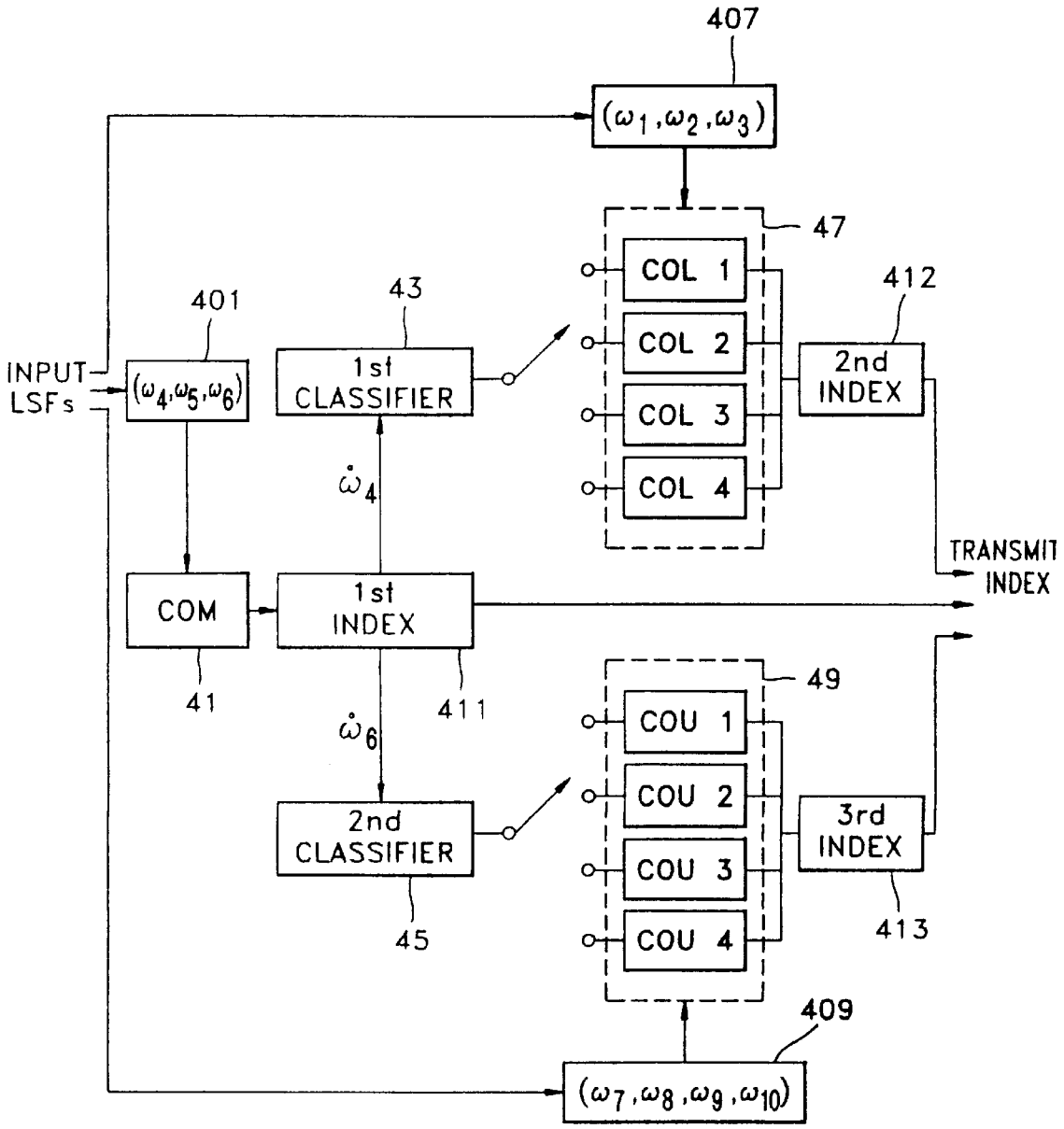
FIG. 4 is a device diagram realizing an encoding method according to the present invention.

FIG. 4 is a diagram illustrating an encoding method according to the present invention.

In FIG. 4, a coder converts the input 10th-order LSF's into three codebook indexes, that is, first, second and third indexes 411, 412 and 413, and transmits the codebook indexes.

First, the 10th-order LSF's is divided into (3, 3, 4)th code vectors and three of middle LSF's ($\omega_4$, $\omega_5$, $\omega_6$) are quantized, providing the quantized code vectors ($\omega_4$, $\omega_5$, $\omega_6$). Each proper codebook of the lower code vectors ($\omega_1$, $\omega_2$, $\omega_3$) 407 and the upper code vectors ($\omega_7$, $\omega_8$, $\omega_9$, $\omega_{10}$) 409 are selected by a first classifier 43 and a second classifier 45 according to the quantized code vectors $\dot{\omega}_4$ and $\dot{\omega}_6$, and then the lower code vectors 407 and the upper code vectors 409 are quantized.

A codebook of lower code vectors COL 47 and codebook of upper code vectors COU 49 are each classified into four classes, and a codebook to be used among those is selected according to a code vector selected in a codebook of middle code vectors COM 41.

First, the middle code vectors ($\omega_4$, $\omega_5$, $\omega_6$) 401 of the LSF's are quantized by using the COM 41, thereby obtaining a corresponding codeword index, that is, a first index 411. For obtaining the nearest codevector, the following weighted Euclidean distance measure $d(\omega,\dot{\omega})$ is used.

$$d(\omega,\acute{\omega}) = \sum_i v(i)\,[\omega_i - \acute{\omega}_i]^2$$

wherein, $\omega$ represents original LSF before the quantization, $\omega$ represents values of codevector stored in the codebook after quantization, $\omega_i$ and $\omega_i$ represent ith LSF before and after quantization, respectively, and v(i) represents a variable weight function of the ith LSF. Also, if the COL is used, i is equal to 1, 2 and 3, and if the COM is used, i is equal to 4, 5 and 6, and if the COU is used, i is equal to 7, 8, 9 and 10.

Here, v(i) is obtained through the following formula.

$$v(i) = \frac{1}{\min[\omega_i - \omega_{i-1}, \omega_{i+1} - \omega_i]}, \quad i = 1, 2, \ldots,$$

wherein, p=10, $\omega_0$0 and $\omega_{P+1}=f_s/2$ ($f_s$ is a sampling frequency). According to the variable weight function, as formant frequencies are given weight, quality of sound is much increased than the othercase.

Second, it is determined by the first classifier 43 which codebook of the COL 47 is to be used, according to the quantized codevector $\omega_4$. Then, like the above first process, the lower code vectors ($\omega_1$, $\omega_2$, $\omega_3$) 407 are quantized, thereby obtaining a second index 412. Here, the determination of the codebook of lower code vectors according to the quantized codevector $\omega_4$ is performed in the same manner as described with reference to FIG. 1.

Third, in the same method as described above, it is determined by the second classifier 45 which codebook of the CQU 49 is to be used, according to the quantized codevector $\omega_6$, and a third index 413 is obtained according to the result. Then, the first, second and third indexes 411, 412 and 413 are transmitted. Here, the determination of the codebook of upper code vectors is performed in the same manner as described with reference to FIG. 2. Also, there is no need for additional bit transmission since COL and COU are selected by the first index 411.

Referring to FIG. 4, the quantization process according to the present invention will be summarized as follows: first, the middle code vectors 401 are quantized to obtain the codevectors ($\omega_4$, $\omega_5$, $\omega_6$), and second, the lower and upper code vectors 407 and 409 are quantized by using corresponding one of codebooks COL 47 and COU 49 which are selected according to the range of the quantized codevectors $\omega_4$ and $\omega_6$.

Figure 5:
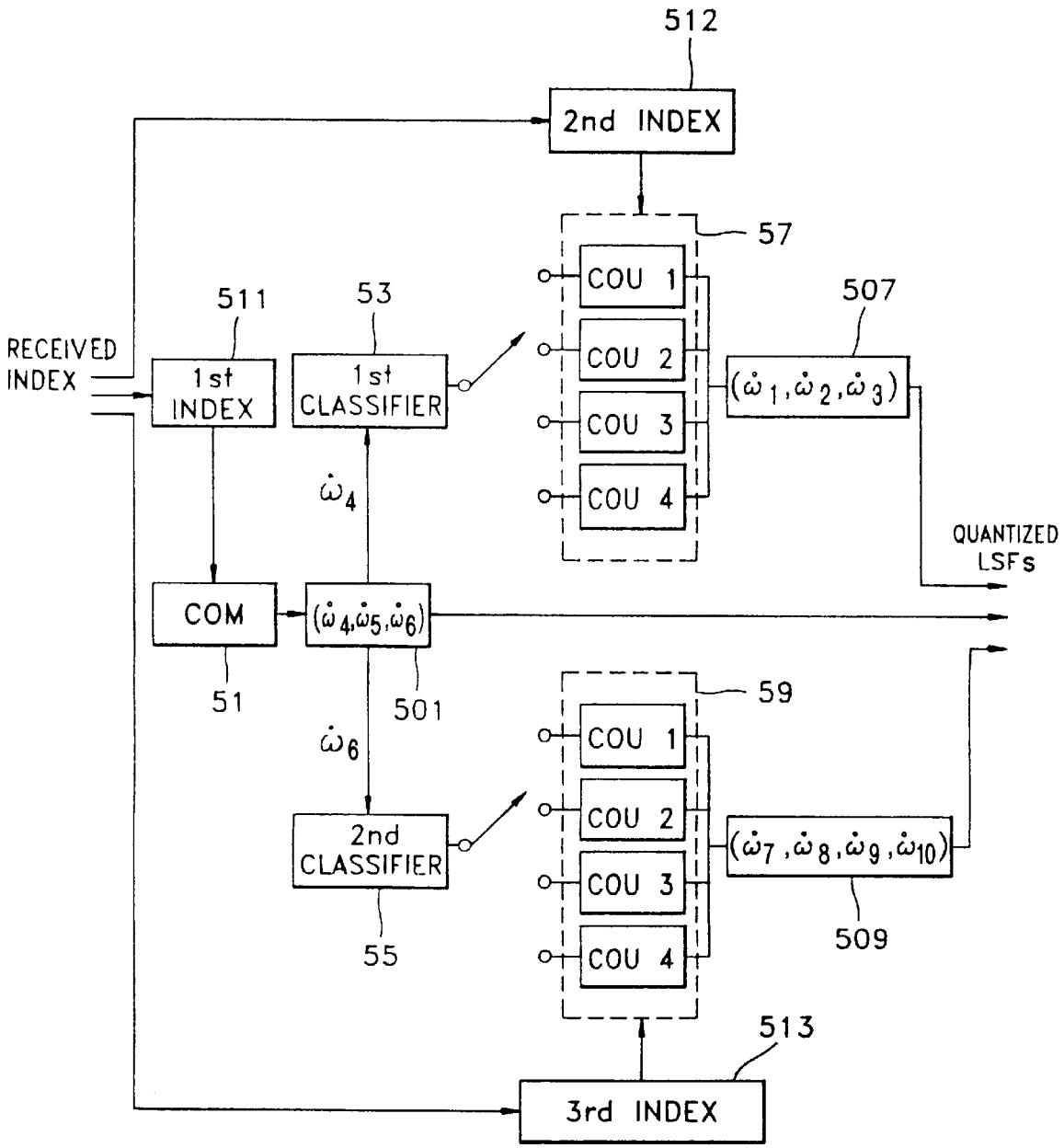
FIG. 5 is a device diagram realizing a decoding method according to the present invention.

FIG. 5 is a diagram illustrating a decoding method according to the present invention.

In FIG. 5, a decoder reconstructs three codebook indexes, that is, first, second and third indexes 511, 512 and 513, which are transmitted from the coder, into quantized 10th-order codevectors 501, 507 and 509.

First, three quantized middle codevectors ($\omega_4$, $\omega_5$, $\omega_6$) 501 are determined by the first index 511 according to a COM 51. Then, for the reconstruction of quantized lower and upper codevectors ($\omega_1$, $\omega_2$, $\omega_3$) 507 and ($\omega_7$, $\omega_8$, $\omega_9$, $\omega_{10}$) 509, each proper codebook is selected from COL 57 and COU 59 by first and second classifier 53 and 55 on the basis of the quantized codevectors $\omega_4$ and $\omega_6$. Thereafter, the quantized lower and upper codevectors ($\omega_1$, $\omega_2$, $\omega_3$) 507 and ($\omega_7$, $\omega_8$, $\omega_9$, $\omega_{10}$) 509 are reconstructed by the second and third indexes 512 and 513, using the selected codebooks, respectively.

The decoding process will be summarized as follows. That is, a codevector corresponding to the first index 511 is selected using the COM 51, thereby obtaining the quantized lower codevectors ($\omega_1$, $\omega_2$, $\omega_3$) 507. Also, a COL and COU to be used can be selected by the first and second classifiers 53 and 55 according to the quantized codevectors $\omega_4$ and $\omega_6$, respectively, so that codevectors corresponding to the second and third indexes 512 and 513 are selected, thereby completing the decoding process.

In support of the effect of the present invention, the following test was executed. Here, the vector quantization of the present invention is called a linked split vector quantization (LSVQ).

For measuring the performance of the LSVQ, 250 of Korean speech (20 min) corrected from 10 persons as used as a speech data for training, and Korean and English speech (1 min, respectively) including noise, and Korean speech (1 min) without noise were used as a test data. A 10th-order LPC analysis was performed with respect to the speech data per 20 ms on the basis of an autocorrelation function, and then the LPC coefficient was converted into LSF's. Also, the LSF's were divided into three code vectors of (3,3,4) dimension for efficiency in the quantization.

Thereafter, the performance of the LSVQ was compared with those of the conventional split vector quantization (SVQ), differential LSF split vector quantization (DSVQ) and the like. For the performance test, a spectral distortion (SD) measure was used. Here, the SD of ith frame is expressed as the following formula.

$$SD_i = \frac{1}{b-a} \sum_{j=a}^{b-1} \left| 10 \log_{10} |P_j|^2 - 10 \log_{10} |\overline{P_j}|^2 \right|$$

wherein, $P_j$ represents power spectrum of the original LSF's, $\overline{P_j}$ represents power spectrum of the quantized LSF's. Here, a and b are equal to 125 Hz and 3,400 Hz, respectively, which are determined considering the characteristic of human ear.

Table 2 shows average SD and outlier percent in accordance with various bit rates, which are for the performance test of the LSVQ. Since the COL and COM are sensitive to a codevector selected in the COM, much more bits were allocated to the COM than to the COL and COU. For example, 8 bits and 7 bits are allocated to the COL and COU, respectively, at 24 bits/frame. However, at the same bit rate, 9 bits are allocated to the COM to select just middle codevector.

TABLE 2

| bit/frame | average SD | outlier percent (%) | |
|---|---|---|---|
| (COL, COM, COU) | (dB) | 2dB ~ 4dB | >4dB |
| 21 ( 6, 8, 7 ) | 1.14 | 2.28 | 0.00 |
| 22 ( 6, 9, 7 ) | 1.07 | 1.71 | 0.00 |
| 23 ( 7, 9, 7 ) | 1.01 | 1.53 | 0.00 |
| 24 ( 8, 9, 7 ) | 0.98 | 1.46 | 0.00 |

Table 3 shows average SD and outlier percent at the bit rate of 24 bits/frame for comparing the performances of the LSVQ according to the present invention and of the conventional SVQ and DSVQ. As seen in Table 2, the average SD and outlier percent in the LSVQ according to the present invention are lower than those in the conventional algorithms.

TABLE 3

| quantizer | average SD | outlier percent (%) | |
|---|---|---|---|
| (24 bits/frame) | (dB) | 2dB ~ 4dB | >4dB |
| S V Q | 1.03 | 1.60 | 0.12 |
| D S V Q | 1.19 | 5.58 | 0.12 |
| L S V Q | 0.98 | 1.46 | 0.00 |

As shown in Tables 2 and 3, the performance of the LSVQ at 23 bits/frame is better than those of the conventional SVQ and DSVQ at 24 bits/frame.

Table 4 comparatively shows codebook utilization ratio at 24 bits/frame in the conventional SVQ and the LSVQ according to the present invention. As known from Table 4, 86.93% of the codebook is used in the SVQ. However, according to the LSVQ of the present invention, 97.77% of the codebook is used. This high codebook utilization ratio means that the quantization into more exact codevectors leads to excellent performance. That is, in the LSVQ of the present invention, space which cannot be used in the SVQ can be searched, thereby improving performance.

TABLE 4

| quantizer | COL (%) | COU (%) | average (%) |
|---|---|---|---|
| S V Q | 84.99 | 90.81 | 86.93 |
| L S V Q | 97.75 | 97.77 | 97.77 |

As described above, according to the present invention where the LSF's is quantized using the LSVQ, the search of the codebook is much more efficiently performed, so that the spectral distortion and outlier percent are lower at 23 bits/frame than those of the conventional SVQ at 24 bits/frame.

What is claimed is:

1. A code book training method for vector-quantizing nth-order line spectral frequencies of an input speech signal, the code book training method comprising:

performing linear predictive analysis of an input speech signal to produce a linear predictive encoding coefficient;

converting the linear predictive encoding coefficient into line spectral frequencies of an nth-order;

dividing the nth-order line spectral frequencies into a plurality of lower, middle, and upper code vectors;

training the middle code vectors with a middle code book;

training the lower code vectors with a plurality of lower code books according to a relationship between a lowermost line spectral frequency of the middle code vectors and the line spectral frequencies of the lower code vectors; and training the upper code vectors with a plurality of upper code books according to a relationship between an uppermost line spectral frequency of the middle code vectors and the line spectral frequencies of the upper code vectors.

2. The code book training method as claimed in claim 1 comprising allocating more bits per frame to the middle code book than to the lower and upper code books.

3. The code book training method as claimed in claim 1, wherein training the middle code vectors includes performing a Linde, Buzo, Gray algorithm.

4. The code book training method as claimed in claim 1, wherein training the lower code vectors comprises:

classifying a range of the lowermost line spectral frequency of the middle code vectors into a plurality of classes; and training the lower code vectors with a number of lower code books corresponding to a number of classes according to a joint probability distribution between the lowermost line spectral frequencies of the middle code vectors corresponding to the classes and the line spectral frequencies of the lower code vectors.

5. The code book training method as claimed in claim 4, wherein classifying the range of the lowermost line spectral frequency of the middle code vectors includes selecting the range of the lowermost line spectral frequency of the middle code vectors so that the cumulative probability distributions of the middle code vectors are the same in each class.

6. The code book training method as claimed in claim 1, wherein training the upper code vectors comprises:

classifying a range of the uppermost line spectral frequency of the middle code vectors into a plurality of classes; and training the upper code vectors with a number of upper code books corresponding to a number of classes according to a joint probability distribution between the uppermost line spectral frequency of the middle code vectors corresponding to the classes and the line spectral frequencies of the upper code vectors.

7. The code book training method as claimed in claim 6, wherein classifying the range of the uppermost line spectral frequency of the middle code vectors includes selecting the range of the uppermost line spectral frequency of the middle code vectors so that the cumulative probability distributions of the middle code vectors are the same in each class.

8. A method of encoding a speech signal comprising:

performing linear predictive analysis of an input speech signal to produce a linear predictive encoding coefficient;

converting the linear predictive encoding coefficient into line spectral frequencies of an nth-order;

dividing the nth-order line spectral frequencies into a plurality of lower, middles and upper code vectors;

quantizing the middle code vectors using a middle code book to generate a first index;

selecting one of a plurality of lower code books according to a lowermost line spectral frequency of the middle code vector and the line spectral frequencies of the lower code vectors, and quantizing the lower code vectors using the selected lower code book to generate a second index;

selecting one of a plurality of upper code books according to the uppermost line spectral frequency of the middle code vector and the line spectral frequencies of the upper code vectors, and quantizing the upper code vectors using the selected upper code book to generate a third index; and transmitting the first, second and third indexes.

9. The method of claim 8, wherein quantizing the upper, middle, and lower code vectors includes determining a weighted Euclidean distance measure $d(\omega,\omega)$ for obtaining a nearest code vector for a code vector being quantized, wherein the weighted Euclidean distance measure $d(\omega,\omega)$ is obtained from $$d(\omega,\acute{\omega}) = \sum_{i}^{n} v(i)\,[\omega_i - \acute{\omega}_i]^2$$

wherein $\omega$ represents initial line spectral frequencies before the quantization, $\omega$ represents values of code vectors stored in the middle code book after quantization, $\omega_i$ and $\omega$ represent ith line spectral frequencies before and after quantization, respectively, and v(i) represents a variable weight function of the ith line spectral frequency, obtained from $$v(i) = \frac{1}{\min[\omega_i - \omega_{i-1}, \omega_{i+1} - \omega_i]}, \quad i = 1, 2, \ldots, p$$

wherein $\omega_0=0$, $\omega_{P+1}=f_S/2$, and $f_S$ is a sampling frequency for the input speech signal.

10. A method of decoding a speech signal encoded as first, second, and third indexes generated by dividing nth-order line spectral frequency coefficients of the speech signal into lower, middle, and upper code vectors and quantizing the divided code vectors into the line spectral frequency coefficients, the method comprising:

selecting a code vector corresponding to the first index using a middle code book to generate quantized middle code vectors;

selecting one of a plurality of lower code books according to a lowermost line spectral frequency of the middle code vectors and selecting a code vector corresponding to the second index using the selected lower code book to generate quantized lower code vectors;

selecting one of a plurality of upper code books according to the uppermost line spectral frequency of the middle code vectors and selecting a code vector corresponding to the third index using the selected upper code books to generate quantized upper code vectors; and reconstructing an input speech signal from the quantized lower, middle, and upper code vectors.

* * * * *

UNITED STATES PATENT AND TRADEMARK OFFICE

CERTIFICATE OF CORRECTION

PATENT NO. : 5,822,723

DATED : October 13, 1998

INVENTOR(S) : Kim et al.

It is certified that error appears in the above-identified patent and that said Letters Patent is hereby corrected as shown below:

Column 10, Line 2, change "middles" to --middle--;

Line 21, change "$d(\omega,\omega)$" to --$d(\omega,\acute{\omega})$--;

Line 23, change "$d(\omega,\omega)$" to --$d(\omega,\acute{\omega})$--;

Line 31, change "$\omega$" to --$\acute{\omega}$--;

Line 32, change "$\omega$" to --$\acute{\omega}_i$--.

Signed and Sealed this

Twelfth Day of January, 1999

*Attest:*

*Attesting Officer*

*Acting Commissioner of Patents and Trademarks*